US006302211B1

(12) United States Patent
Nelson et al.

(10) Patent No.: US 6,302,211 B1
(45) Date of Patent: Oct. 16, 2001

(54) APPARATUS AND METHOD FOR REMOTELY INSTALLING SHOULDER IN SUBSEA WELLHEAD

(75) Inventors: John E. Nelson; Lionel J. Milberger; Amin Radi, all of Houston, TX (US); Norman Brammer, Aberdeen (GB)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 09/369,794

(22) Filed: Aug. 6, 1999

Related U.S. Application Data

(60) Provisional application No. 60/096,560, filed on Aug. 14, 1998.

(51) Int. Cl.[7] ..... E21B 33/038; E21B 33/043

(52) U.S. Cl. ..... 166/348; 166/75.14; 166/338; 166/382

(58) Field of Search ..... 166/348, 382, 166/115, 85.3, 208, 75.14

(56) References Cited

U.S. PATENT DOCUMENTS

| | | | | |
|---|---|---|---|---|
| 3,273,646 | * | 9/1966 | Walker | 166/124 |
| 3,543,847 | | 12/1970 | Haeber . | |
| 3,661,206 | * | 5/1972 | Putch et al. | 166/89.2 |
| 3,693,714 | * | 9/1972 | Baugh | 166/348 |
| 3,741,294 | * | 6/1973 | Morrill | 166/382 X |
| 3,827,488 | * | 8/1974 | Piazza et al. | 166/208 |
| 3,847,215 | * | 11/1974 | Herd | 166/348 X |
| 3,871,449 | * | 3/1975 | Ahlstone | 166/208 X |
| 4,289,206 | * | 9/1981 | Kirkland | 166/348 |
| 4,422,507 | | 12/1983 | Reimert . | |
| 4,674,576 | * | 6/1987 | Goris et al. | 166/382 |
| 4,995,458 | * | 2/1991 | Garbett | 166/85.3 |
| 5,620,052 | | 4/1997 | Turner . | |
| 5,653,289 | * | 8/1997 | Hosie et al. | 166/348 |
| 5,655,606 | | 8/1997 | Ferguson . | |
| 6,035,938 | * | 3/2000 | Watkins | 166/348 X |

FOREIGN PATENT DOCUMENTS

| | | | | |
|---|---|---|---|---|
| 552525 A1 | * | 7/1993 | (EP) | 166/208 |
| 592736 A1 | * | 4/1994 | (EP) | 166/208 |

OTHER PUBLICATIONS

SPE/IADC 37615 "Wellbore Design W/Reduced Clearance Between Casing Strings" /Barker/1997.

* cited by examiner

*Primary Examiner*—David Bagnell
*Assistant Examiner*—Jong-Suk Lee
(74) *Attorney, Agent, or Firm*—Bracewell & Patterson LLP

(57) ABSTRACT

A running tool is used to install a load shoulder and a wear bushing in a subsea wellhead. A subsea wellhead has a locator shoulder, and grooved upper and lower profiles. The running tool has a cylindrical wear bushing that lands on a locator shoulder provided in the bore above a grooved lower profile in a wellhead housing. The running tool also carries a load shoulder ring and a split lock ring. The installation process consists of preparing the tool before running the tool subsea. Flowby ports on the running tool remain open during installation to speed the trip-in operation. The flowby ports are closed by lowering the central mandrel after the running tool lands. Then a portion of the wear bushing is moved downward, which in turn pushes the load shoulder out into the lower grooved profile to retain the load shoulder ring and wear bushing with the wellhead.

16 Claims, 6 Drawing Sheets

APPARATUS AND METHOD FOR REMOTELY INSTALLING SHOULDER IN SUBSEA WELLHEAD

CROSS-REFERENCE TO RELATED APPLICATIONS

This application claims the benefit of provisional application Ser. No. 60/096,560, filed on Aug. 14, 1998, in the United States Patent & Trademark Office.

BACKGROUND OF INVENTION

This invention relates in general to subsea wellheads and in particular to a load shoulder for a casing hanger that is remotely installable in a subsea wellhead housing.

When drilling a well for oil or gas, typically a wellhead housing will be mounted at the upper end of the well to a large diameter string of conductor pipe. The well is then drilled deeper and a string of casing will be run. Subsequently, the well will be drilled to a greater depth and at least one more strings of casing will be installed.

A casing hanger is located at the upper end of each string of casing, the casing hanger landing on a load shoulder in the wellhead housing. In one type of wellhead housing, the lowest shoulder is machined into the bore of the wellhead housing. Upper casing hangers are supported on lower casing hangers. In another type, the load shoulder is a separate high strength ring that is installed into a groove in the wellhead housing while the wellhead housing is being manufactured. In both cases, the inner diameter of the wellhead housing bore will decrease in a downward direction, with the smaller inner diameter located below the load shoulder.

The stepped diameter bore has a disadvantage. Drilling tools can be no larger than the minimum inner diameter located below the load shoulder. Sometimes, it is desired to utilize a drill bit or tool that is larger than minimum inner diameter.

For example, in a wellhead system that is used in containment of offshore shallow flow zones, it is desired to run a casing, which is typically 18" in diameter, through a subsea high pressure housing having a minimum bore that is typically 18.63". The nominal seat of the high pressure housing, i.e., the insert load shoulder, must be removed or left off of the assembly prior to running a high pressure housing and then reinstalled subsequent to the installation of the casing. Therefore, it is desirable to provide a means to install a nominal seat in a high pressure housing, run in an appropriate wear bushing and test the blowout preventer in a single trip, thereby saving two additional trips and the costs associated therewith.

SUMMARY OF THE INVENTION

In this invention a running tool is employed to run a split lock ring. The running tool has a cylindrical wear bushing that lands on a locator shoulder provided in the bore above a grooved lower profile in a wellhead housing. The running tool carries a load shoulder ring and a split lock ring. The installation process consists of preparing the tool and running the tool subsea. On a rig floor, a load shoulder ring, a lock ring and a wear bushing are installed on a running tool. Flowby ports are provided in the running tool, which remain open during installation to speed the trip-in operation. Previously, the high pressure housing will have been landed. The high pressure housing should have a locator shoulder located below a grooved upper profile. A riser will extend from the high pressure housing to the drilling platform. The running tool is lowered on the drill pipe through the riser and landed in the high pressure housing. The flowby ports are then closed. The flowby ports may be closed by rotating the drill string, thereby disengaging a pin from a J-housing on the running tool. The operator then lowers the drilling platform, causing a central mandrel in the tool to drop.

The blowout preventer is then closed on the drill string. Pressure is applied to a choke-and-kill line below the blowout preventer. An internal piston within the running tool transfers the pressure to an intermediate portion of the wear bushing. The wear bushing is ratcheted downward, which drives the load shoulder ring downward, expanding the lock ring into engagement with the grooved lower profile on the inside of the wellhead housing. The downward motion of the load shoulder ring compresses annular springs and maintains the annular springs in a compressed configuration.

The blowout preventer may then be tested. Finally, the tool is removed by pulling upwards on the drill pipe. By pulling up on the drill pipe, upper ports on the flowby passages are exposed, thereby opening the flowby ports to speed up the trip-out operation.

BEST MODE FOR CARRYING OUT THE INVENTION

Figure 1A:
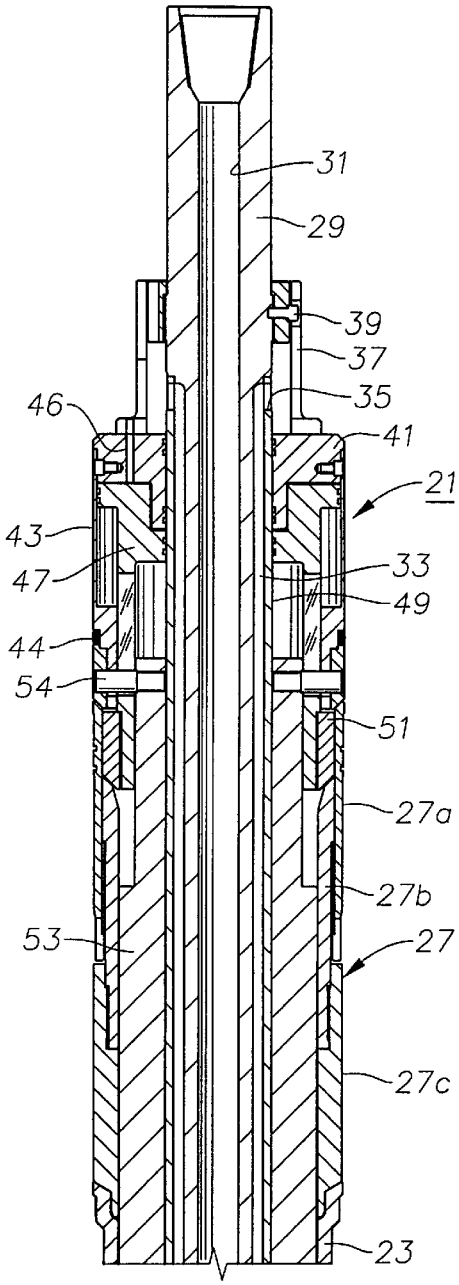
FIGS. 1A and 1B comprise a vertical sectional view of a running tool in the process of being lowered into a subsea wellhead housing for installing a load shoulder ring and wear bushing.
Figure 1B:
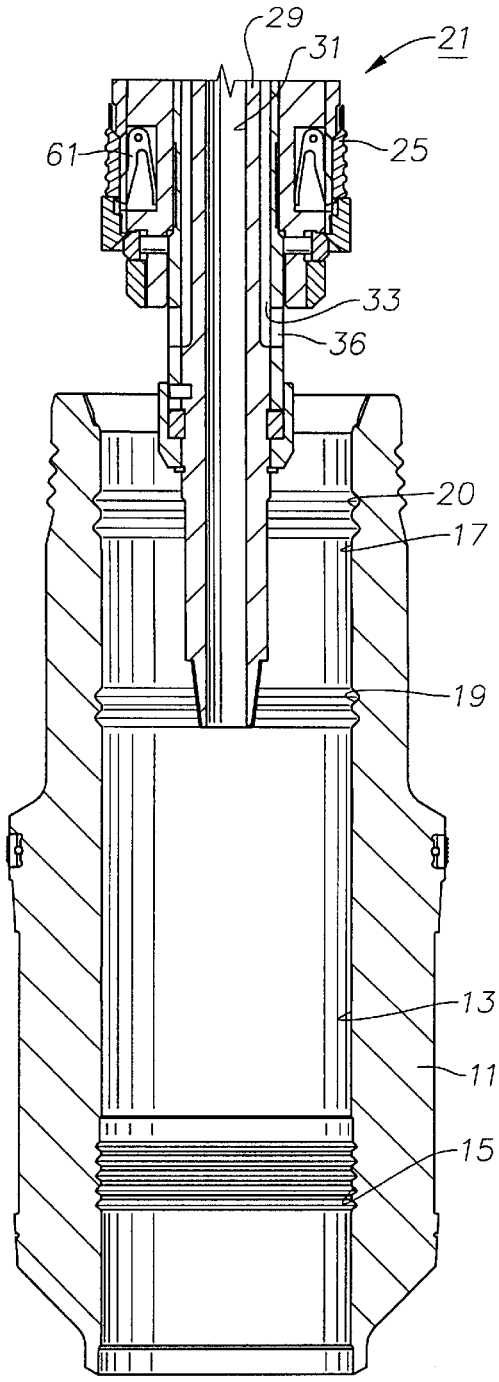

Referring to FIGS. 1A and 1B, a subsea wellhead housing 11 will be previously installed on the seabed. Wellhead housing 11 is a high pressure tubular member installed within a lower pressure wellhead (not shown). The lower end of wellhead housing 11 is secured to a string of casing (not shown) that extends into the well. Wellhead housing 11 has a bore 13 which is substantially full bore or constant in diameter throughout its length. Bore 13 has a lower profile 15 made up of a series of grooves. A running tool locator shoulder 17 is located near an upper end of bore 13. Shoulder 17 is a very slight upward facing ridge, being a small fraction of an inch in radial width. An intermediate profile 19 is located below running tool shoulder 17, and an upper profile 20 is located above running tool shoulder 17. Profiles 19, 20 are utilized subsequently when installing casing and a tubing hanger.

FIGS. 1A, 1B show a running tool 21 being lowered from a vessel on a string of drill pipe (not shown) into bore 13. Running tool 21 will run a load shoulder ring 23, which is shown installed in FIG. 6. Load shoulder ring 23 is used to support a casing hanger (not shown). Load shoulder ring 23 is supported on a lock ring 25, which in turn engages profile 15.

Figure 5:
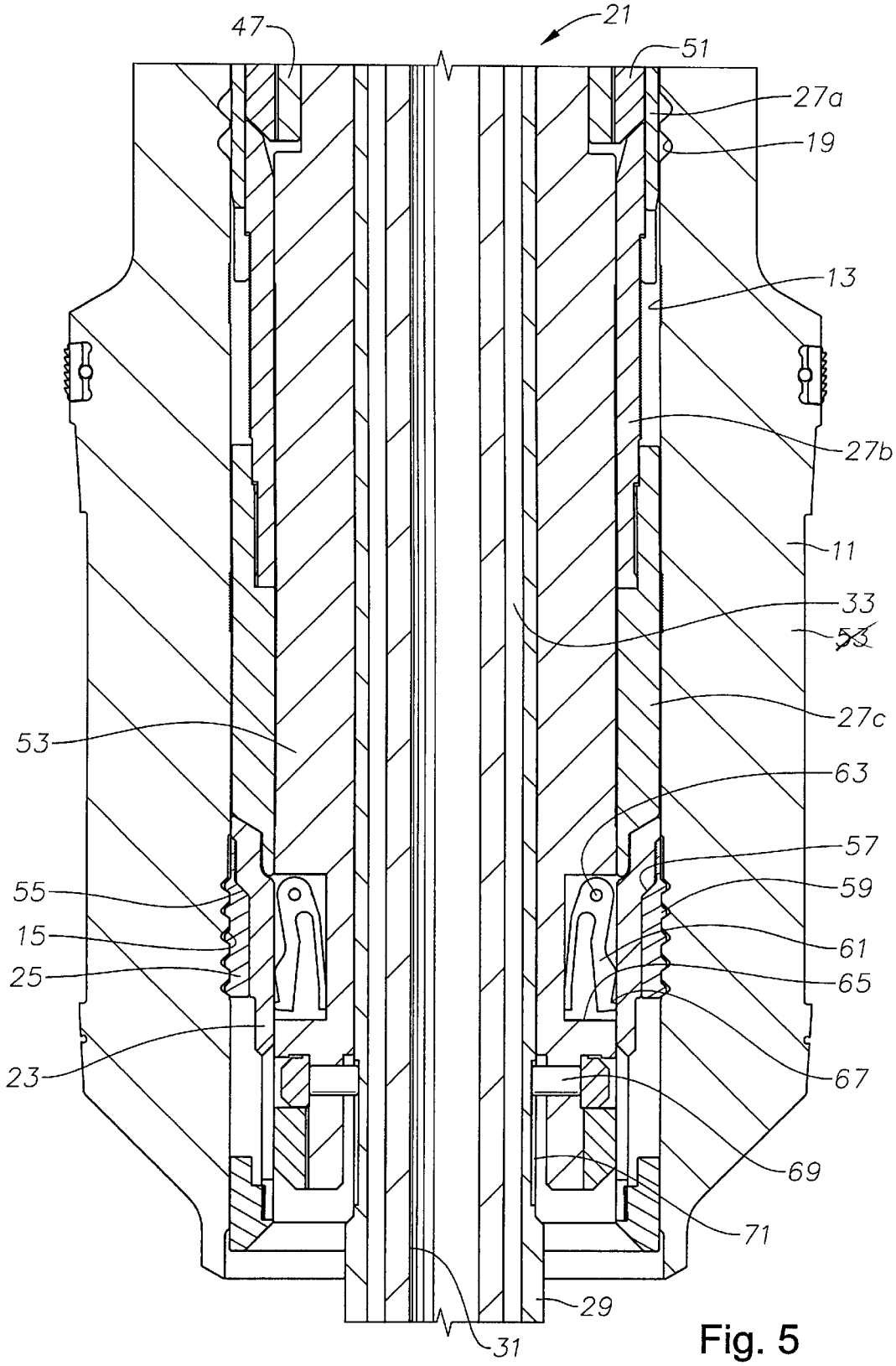
FIG. 5 is an enlarged sectional view of a lower portion of the running tool, shown after the load shoulder ring has moved down into engagement with a lock ring.
Figure 6:
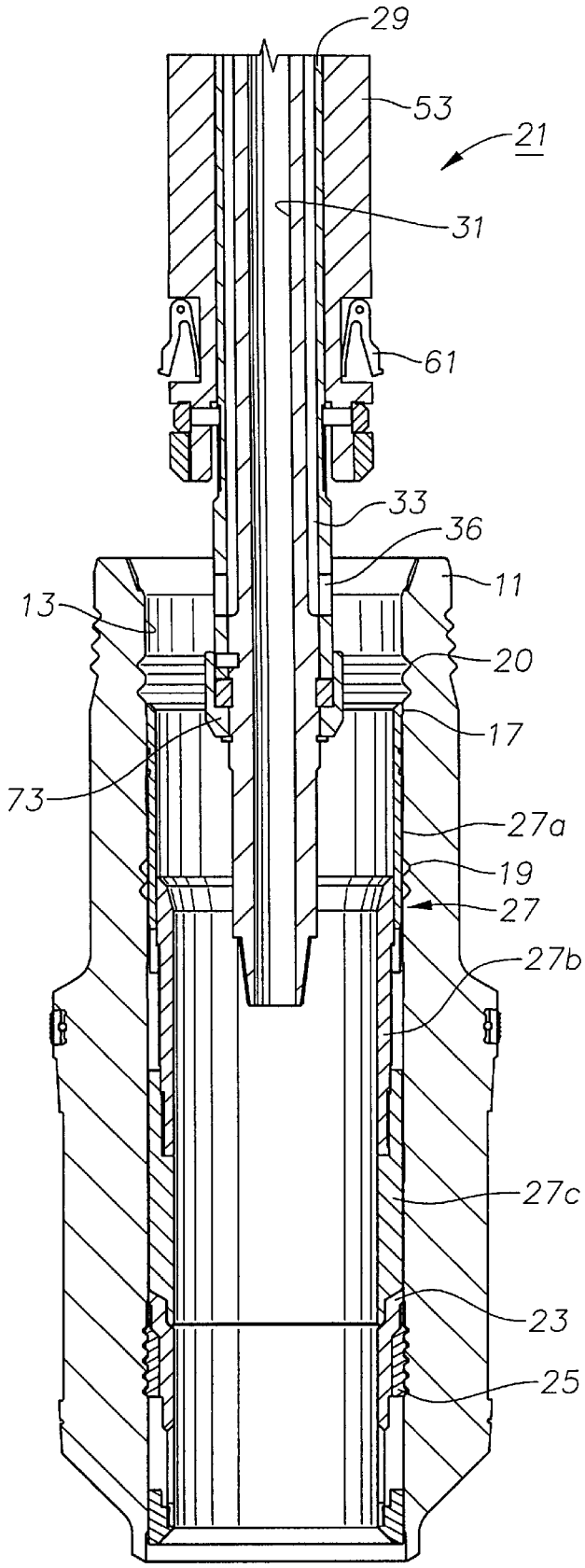
FIG. 6 is a sectional view of the load shoulder and a wear bushing installed in the wellhead housing and the running tool being removed.

Also, preferably, running tool 21 simultaneously installs a wear bushing 27. Wear bushing 27 is a tubular liner which is made up of three components, an upper portion 27*a*, an intermediate portion 27*b*, and a lower portion 27*c*. Upper portion 27*a* has an external lip at its upper end for landing on locator shoulder 17. Upper portion 27*a* is a thin cylindrical member which will protect intermediate profile 19 from damage during drilling operations. Intermediate member 27*b* and lower member 27*c* will slide axially relative to upper portion 27*a*. Intermediate portion 27*b* is secured by threads to lower portion 27*c*, which in turn abuts the upper end of load shoulder ring 23. FIGS. 5 and 6 show wear bushing 27 in an extended position while the other figures show wear bushing 27 in a contracted position.

Referring again to FIG. 1A, running tool 21 includes a central mandrel 29 that extends the length of the tool. Mandrel 29 has an upper end that is adapted to be secured to a string of drill pipe. The lower end of mandrel 29 has threads that also allow it to be secured to components below, if desired. Mandrel 29 has an axial passage 31 that extends throughout its length. A plurality of flowby passages 33 extend axially but along the sides of mandrel 29. Each flowby passage 33 has an upper port 35 and an lower port 36. When in the running-in position shown in FIGS. 1 and 2, passage 33 allows fluid flow from below running tool 21 to above. In the landed position shown in FIGS. 3 and 4, upper port 35 is blocked, preventing flow of fluid through passage 33.

The mechanism which is used to block upper port 35 includes a J-housing 37 which has a J-slot for receiving a pin 39. Pin 39 is secured to mandrel 29 for movement therewith. J-housing 37 is an uppermost or first part of a body of running tool 21 and is mounted to a blocking sleeve 41. Blocking sleeve 41, a second part of the body of running tool 21, will sealingly engage mandrel 29 and allow mandrel 29 to move from an upper position to a lower position. Mandrel 29 is shown in an upper running-in position in FIGS. 1 and 2 and in a lower landed position in FIGS. 3 and 4. While mandrel 29 is in the landed position, blocking sleeve 41 will block flow through flowby passages 33. Mandrel 29 is moved to the lower position by rotation of mandrel 29 relative to J-housing 37, which causes mandrel 29 to drop to a lower position relative to blocking sleeve 41.

Figure 2:
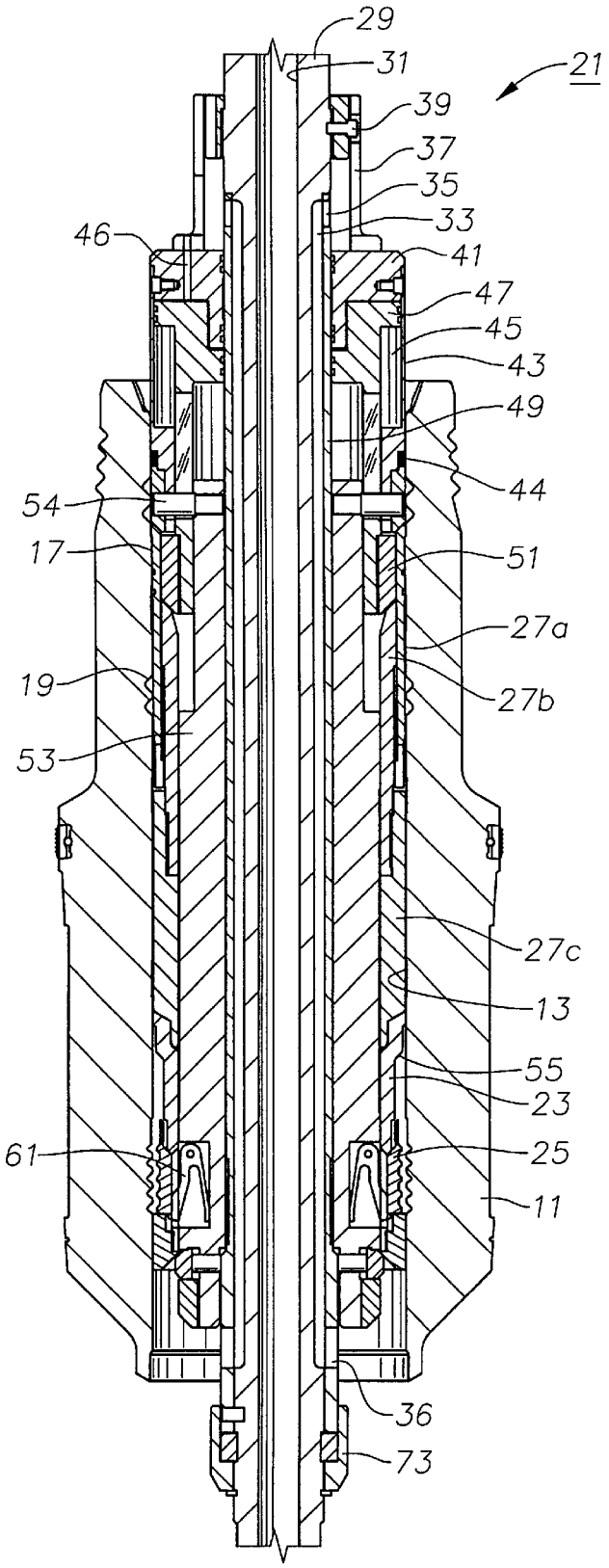
FIG. 2 is an enlarged sectional view of the running tool of FIG. 1, shown initially landed in the wellhead housing.
Figure 4:
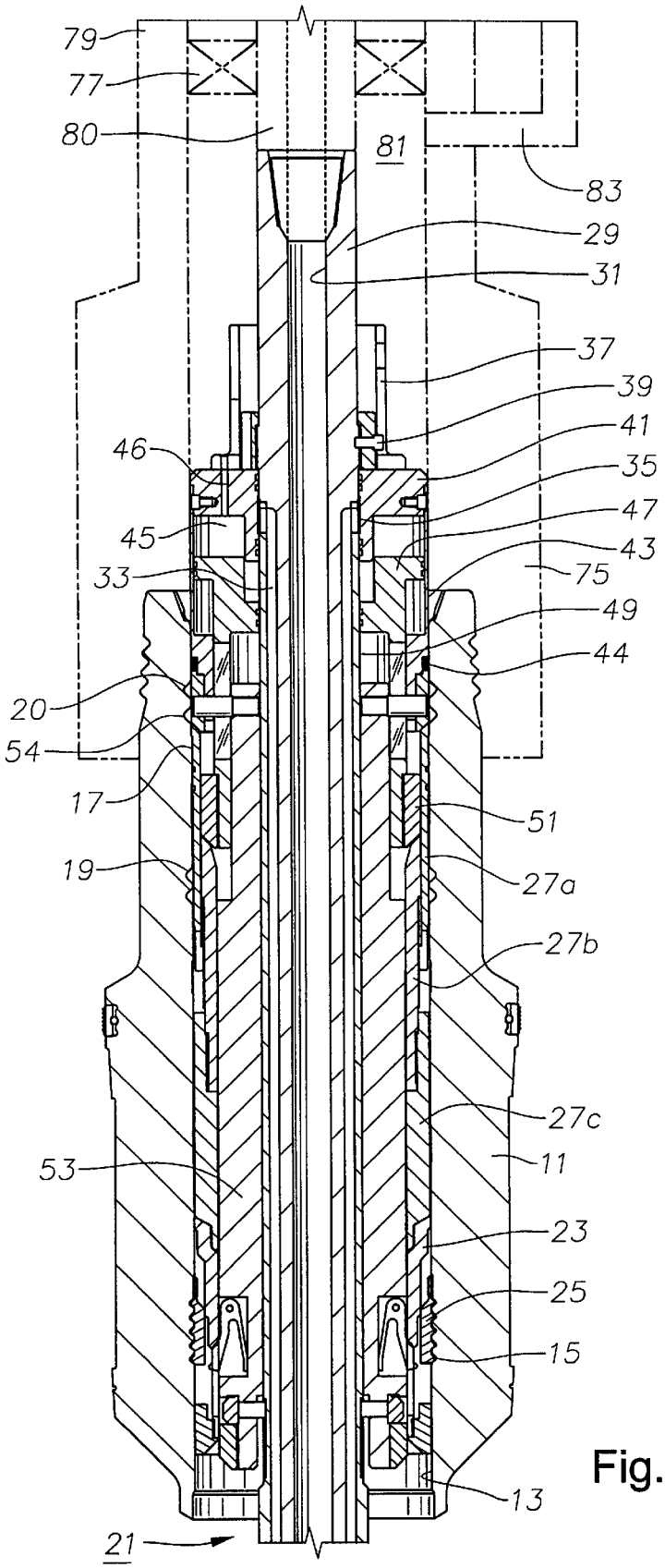
FIG. 4 is a sectional view of the running tool similar to FIG. 3, but schematically showing a riser assembly and pressure being hydraulically applied to the running tool.

Referring still to FIG. 2, blocking sleeve 41 is rigidly secured to a third body portion 43. A seal 44 surrounds body portion 43 and seals in bore 13 of wellhead housing 11. Body portion 43 has a piston chamber 45 within it. A port 46 extends through blocking sleeve 41, communicating the exterior with chamber 45 above a piston 47. Piston 47 is located in chamber 45 and will stroke from the upper position shown in FIG. 2 to a lower position. FIG. 4 shows piston 47 moving toward the lower position. The outer diameter of piston 47 sealingly and slidingly engages body portion 43. The inner diameter of piston 47 sealingly and slidingly engages a mandrel sleeve 49, which may be considered part of mandrel 29. Mandrel sleeve 49 surrounds mandrel 29 in the area of flowby passages 33 to define passages 33.

Piston 47 is rigidly secured to a transfer ring 51, which in turn bears against an upper end of intermediate wear bushing portion 27*b*. The outer diameter of transfer ring 51 is closely spaced to upper wear bushing portion 27*a*. Downward movement of piston 47 will push intermediate wear bushing portion 27*b* and lower wear bushing portion 27*c* downward to the extended position.

Figure 3:
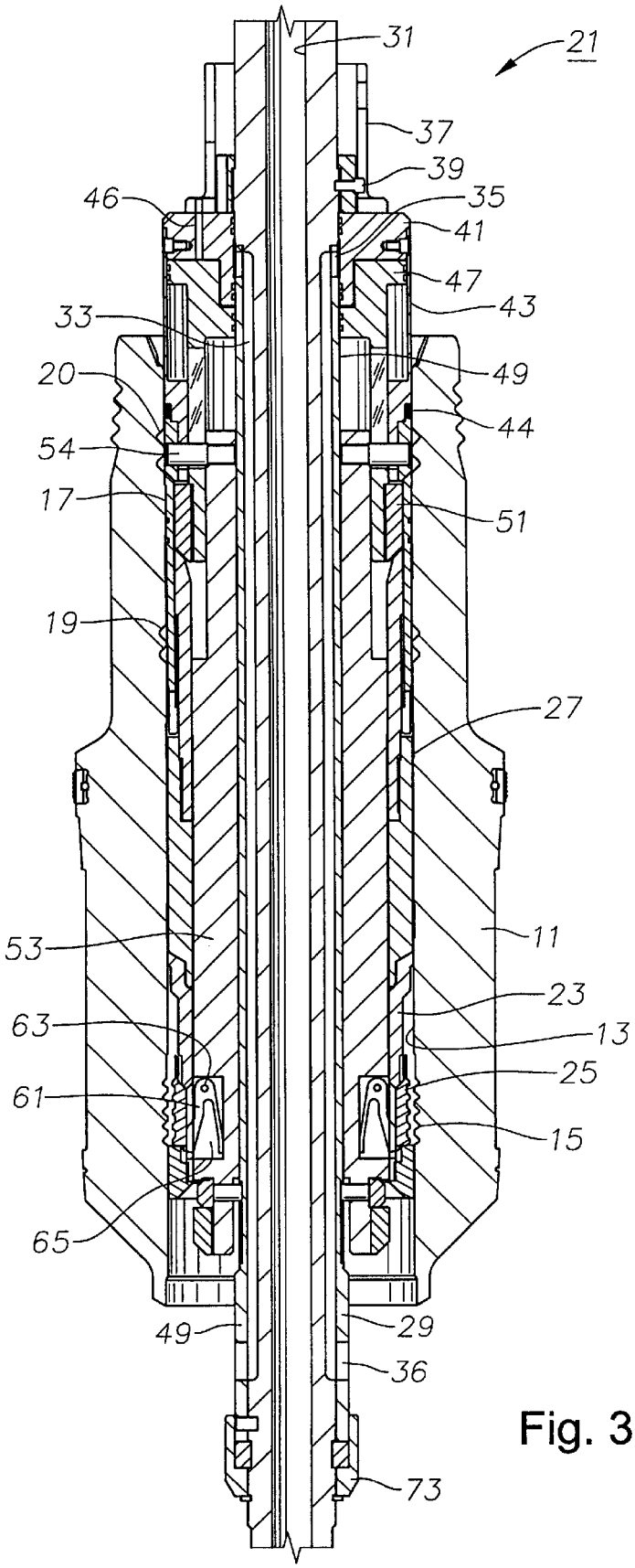
FIG. 3 is a sectional view of the running tool similar to FIG. 2, but showing a mandrel of the running tool moved to a lower position.

A fourth component of the body of running tool 21 is a central body portion 53, which is secured to body portion 43 by radial fasteners 54. Central body portion 53 provides radial support for wear bushing 27. Referring now to FIG. 5, load shoulder ring 23 has an exterior downward facing shoulder 55. When installed, shoulder 55 bears against an inclined upward facing shoulder 57 on lock ring 25. Load shoulder ring 23 is a solid ring, while lock ring 25 is a split ring. Lock ring 25 is inward biased and has a plurality of circumferentially extending ribs 59 which engage grooves of profile 15. FIG. 5 shows shoulder ring 23 in the lower position, with its shoulder 55 in engagement with shoulder 57. In FIGS. 1–3, shoulder ring 23 is still in an upper position located above lock ring 25.

An annular spring 61 is secured by a pivot pin 63 in an annular cavity 65 within central body 53, as shown in FIG. 5. In cross-section, spring 61 has an inner and an outer leg, presenting a generally inverted "V" configuration. Spring 61 has a lower flange or foot 67 on its outer leg which protrudes outward. In the running-in position shown in FIG. 2, foot 67 will engage a lower edge of lock ring 25 to retain it. Downward movement of shoulder ring 23 pushes foot 67 radially inward, compressing the outer leg of spring 61 as shown in FIG. 5, and releasing the engagement of spring 61 with lock ring 25.

Central body portion 53 is retained at its lower end to mandrel 29 by means of a plurality of radial pins 69 which engage an elongated slot 71 on the exterior of mandrel 29. Pins 69 allow movement of mandrel 29 between its upper and lower positions relative to central body portion 53. Referring again to FIG. 2, mandrel sleeve 49 is retained on its lower end by a retainer 73 which is secured to mandrel 29.

Referring to FIG. 4, the dotted lines represent a riser assembly which will be in place prior to lowering running tool 21, but is shown only in FIG. 4. The riser assembly includes a riser connector 75 which is conventional and connected to wellhead housing 11. A blowout preventer 77 (BOP) is connected into and forms a part of the riser assembly. Riser 79 extends upward from BOP 77 to a floating vessel. When BOP 77 is in the closed position shown in FIG. 4, its pipe rams will engage a string of drill pipe 80 which supports running tool 21. The closure of BOP 77 defines an annular cavity 81 within riser 79 below BOP 77. A choke-and-kill line 83 has a lower port through the sidewall of riser 79 into annular cavity 81. Choke-and-kill line 83 extends alongside riser 79 to the surface to allow fluid to be pumped into cavity 81.

In operation, wellhead housing 11 will be previously installed within a low pressure wellhead housing (not shown) and will have at least one string of casing (not shown) secured to the lower end of wellhead housing 11 and extending into the well. Riser 77 (FIG. 4) will also be installed on wellhead housing 11 and extend to the surface. Full bore 13 allows the operator to run an additional string of casing through wellhead housing 11 and land it on a shoulder (not shown) located in the first string of casing below wellhead housing 11. If employed, both the first and second strings of casing supported by wellhead housing 11 would be larger in diameter than the inner diameter of shoulder ring 23. The additional larger diameter string of casing is particularly useful in areas where flowing water sands are located at shallow depths.

At an appropriate time after the larger diameter casing has been run and landed below wellhead housing 11, the operator will install shoulder ring 23 so that it can support one or more strings of casing on casing hangers landed within bore 13. To do this, the operator assembles load shoulder ring 23 and wear bushing 27 onto running tool 21 as shown in FIGS. 1A and 1B. Wear bushing 27 will be in the extended position shown in FIGS. 1A and 1B. The operator lowers running tool 21 on the string of drill pipe 80 (FIG. 4). During the running-in, flowby passages 33 are open to allow fluid flow through running tool 21, other than through its axial passage 31. The assembly will land in wellhead housing 11 as shown in FIG. 2. The lip on upper wear bushing portion 27*a* engages locator shoulder 17 to prevent further downward movement of running tool 21. Seal 44 will sealingly engage bore 13.

The operator then rotates drill pipe 80 (FIG. 4) to cause pin 39 to move within its J-slot in J-housing 37. This allows mandrel 29 to drop to the lower position shown in FIG. 3. When mandrel 29 is moved to the lower position of FIG. 3, blocking sleeve 41 blocks upper port 35 of flowby passages 33. Referring to FIG. 4, BOP 77 is then closed on drill pipe 80. Outer seal 44 provides a sealed lower end to annular cavity 81. The operator pumps a liquid down choke-and-kill line 83 which flows through port 46 to cause piston 47 to stroke downward. As piston 47 moves downward, it will push downward on intermediate wear bushing portion 27*b* and lower wear bushing portion 27*c*, while upper wear bushing portion 27*a* remains stationary. This movement also pushes down on load shoulder ring 23. The outer leg of spring 61 collapses inward, with foot 67 releasing its engagement with the lower edge of lock ring 25 as shown in FIG. 5. Shoulder ring 23 pushes lock ring 25 radially outward, causing it to engage profile 15. Downward movement of lower wear bushing portion 27*c* stops when shoulder ring shoulder 55 engages shoulder 57 of lock ring 25. Shoulder ring 23 backs up lock ring 25, preventing it from collapsing inward.

The operator is now free to open BOP 77 and pull upward on drill pipe 80 to remove running tool 21. As shown in FIG. 6, upward pull simply causes running tool 21 to move upward while shoulder ring 23 and wear bushing 27 remain in place. Wellhead housing 11 is now ready for further drilling. Prior to running of additional casing, wear bushing 27 would be removed by using a retrieval tool to grip and pull it upward. The additional casing will be supported on the upper tapered end of shoulder ring 23.

The invention has numerous advantages. The use of blowout preventer pressure to install a load shoulder ring in a subsea wellhead utilizing blowout preventer pressure enables the blowout preventer to be tested in the same trip. The load shoulder and the wear bushing are installed on the same trip. The invention eliminates the need for an additional trip to install the wear bushing.

While the invention has been shown in only one of its forms, it should be apparent to those skilled in the art that it is not so limited, but is susceptible to various changes without departing from the scope of the invention.

What is claimed is:

1. An apparatus for remotely installing a shoulder in a wellhead housing of a subsea wellhead comprising:

a running tool;

a load shoulder ring in sliding engagement with said running tool, said load shoulder ring having an exterior downward facing shoulder; and an annular spring within an annular cavity in said running tool, said annular spring for facilitating selective engagement of said running tool and said wellhead housing, wherein;

said running tool has a central body portion and a central mandrel; and said central mandrel is slidingly received within said central body portion, said central mandrel slidable to an upper position and a lower position.

2. An apparatus for remotely installing a shoulder in a wellhead housing of a subsea wellhead comprising:

a running tool;

a load shoulder ring in sliding engagement with said running tool, said load shoulder ring having an exterior downward facing shoulder;

an annular spring within a first annular cavity in said running tool, said annular spring for facilitating selective engagement of said running tool and said wellhead housing; a cylindrical wear bushing surrounding a portion of said running tool, said cylindrical wear bushing having an upper wear bushing portion and a lower wear bushing portion; and a piston within a second annular cavity in said running tool, said piston having a lower end for engaging said wear bushing to push said wear bushing downward to act on a lock ring via a load shoulder ring.

3. An apparatus for remotely installing a shoulder in a wellhead housing of a subsea wellhead comprising:

a running tool;

a load shoulder ring in sliding engagement with said running tool, said load shoulder ring having an exterior downward facing shoulder;

an annular spring within an annular cavity in said running tool, said annular spring for facilitating selective engagement of said running tool and said wellhead housing; and a lock ring below said load shoulder ring, said lock ring having an inclined upward facing shoulder that bears against said exterior downward facing shoulder on said load shoulder ring, said lock ring being split and moveable to an outward position by said load shoulder ring, said lock ring having a plurality of circumferentially extending ribs for mating engagement with a lower profile on said wellhead housing.

4. An apparatus for remotely installing a shoulder in a wellhead housing of a subsea wellhead comprising:

a running tool having a central body portion and a central mandrel;

said central mandrel slidingly received within said central body portion, said central mandrel slidable to an upper position and a lower position;

a load shoulder ring in sliding engagement with said running tool, said load shoulder ring having an exterior downward facing shoulder, said load shoulder ring below a wear bushing;

a piston within a first annular cavity in said running tool, said piston having a lower end for engaging said wear bushing to push said wear bushing downward to act on a lock ring via said load shoulder ring; and an annular spring within a second annular cavity in said central body portion proximate said lock ring, said annular spring having an outward protuberance for selective engagement with said lock ring.

5. The apparatus according to claim 4, wherein:

said wear bushing surrounding a portion of said running tool, said wear bushing having an upper wear bushing portion and a lower wear bushing portion.

6. The apparatus according to claim 4, wherein:

said lock ring is below said load shoulder ring, said lock ring having an inclined upward facing shoulder that bears against said exterior downward facing shoulder on said load shoulder ring, said lock ring being split and moveable to an outward position by said load shoulder ring, said lock ring having a plurality of circumferentially extending ribs for mating engagement with a lower profile on said wellhead housing.

7. An apparatus for use in a subsea wellhead having a bore containing upper and lower grooved profiles, comprising:

a running tool having a central body portion and a central mandrel, said mandrel and said central body portion defining a flowby passage between them to allow fluid flowby as said running tool is being lowered through a riser to said subsea wellhead housing;

said central mandrel slidingly received within said central body portion, said central mandrel slidable from an upper position in which said flowby passage is open to a lower position in which said flowby passage is closed after said running tool has landed in said wellhead housing;

a cylindrical wear bushing releasably carried by said running tool for installing over said upper grooved profile of said wellhead housing, said cylindrical wear bushing having an upper wear bushing portion and a lower wear bushing portion;

a load shoulder ring, for supporting a string of casing releasably carried by said running tool below said wear bushing, said load shoulder ring having an exterior downward facing shoulder, and being movable from an upper position to a lower position relative to said central body portion;

a lock ring below said load shoulder ring, said lock ring having an inclined upward facing shoulder that bears against said exterior downward facing shoulder on said load shoulder ring, said lock ring being split and moveable to an outward position by said load shoulder ring when said load shoulder ring moves to the lower position, said lock ring having a profile for mating engagement with the lower grooved profile on said wellhead housing when in the outward position; and a piston in said running tool, said piston being movable in response to hydraulic pressure provided remotely, said piston having a lower end for engaging said wear bushing lower portion to push said wear bushing lower portion downward, relative to said wear bushing upper portion, which in turn pushes said load shoulder ring downward to the lower position, thereby allowing said running tool to be retrieved.

8. The apparatus according to claim 7 wherein:

said upper wear bushing portion lands on a locator shoulder provided in said wellhead housing.

9. The apparatus according to claim 7, further comprising:

an annular spring within an annular cavity in said central body proximate said lock ring, said annular spring having an outward protuberance for selective engagement with said lock ring to releasably retain said lock ring in said upper position.

10. The apparatus according to claim 9 wherein said annular spring comprises:

an inner leg and an outer leg arranged in a generally inverted V-shaped configuration; and wherein said outward protuberance is a lower flange on said outer leg.

11. The apparatus according to claim 7 wherein said flowby passage comprises a channel extending axially along said mandrel and wherein said apparatus further comprises:

a blocking sleeve on said running tool for blocking an upper port of said flowby passage when said central mandrel is in said lower position, said mandrel being movable relative to said blocking sleeve.

12. The apparatus according to claim 7 further comprising:

a J-housing having a J-slot proximate an upper end of said running tool; and a pin extending from said central mandrel for selective engagement with said J-slot for releasably retaining said mandrel in said upper position.

13. The apparatus according to claim 7, wherein:

a seal is adapted to engage the bore of said wellhead housing to provide an annular chamber around said running tool above said seal in said riser, said seal to enable hydraulic pressure to be applied to said annular chamber.

14. The apparatus according to claim 7, further comprising:

a plurality of circumferentially extending ribs on said lock ring.

15. A method of installing a shoulder ring and wear bushing in a subsea wellhead that is connected to a blowout preventer and riser, the wellhead housing having upper and lower grooved profiles in a bore, said method comprising the steps of:

a) providing a running tool having an outer seal, a central body portion and a central mandrel, the body and mandrel defining a flowby passage that is closable by downward movement of said mandrel relative to said body;

b) assembling a load shoulder ring and wear bushing onto the running tool, the wear bushing above the load shoulder ring, the running tool having a piston that engages at least a portion of said wear bushing;

c) lowering said running tool on a string of conduit and allowing fluid flow thorough flowby passages in said running tool during run-in;

d) landing said running tool in a wellhead housing, positioning the wear bushing over the upper grooved profile and positioning the load shoulder ring adjacent the lower grooved profile;

e) lowering said central mandrel relative to said central body portion to close said flowby passage;

f) closing the blowout preventer on said conduit, creating an annular chamber between said outer seal and said blowout preventer; and g) pumping a liquid down a choke-and-kill line to said annular chamber to push the piston and at least a portion of said wear bushing downward, which causes said load shoulder ring to be supported by said lower grooved profile; and h) releasing the hydraulic pressure, opening said blowout preventer, retrieving said running tool, leaving the wear bushing and load shoulder ring in the bore of the wellhead housing.

16. The method according to claim 15 wherein:

said wear bushing has an upper portion and a lower portion; and wherein said upper portion engages a locator shoulder in said wellhead when the running tool lands in the wellhead housing and the piston moves the lower portion downward relative to said upper portion.

* * * * *